US008906294B2

(12) United States Patent
Mizuno et al.

(10) Patent No.: US 8,906,294 B2
(45) Date of Patent: Dec. 9, 2014

(54) MAGNESIUM ALLOY MATERIAL

(75) Inventors: Osamu Mizuno, Itami (JP); Nobuyuki Okuda, Itami (JP); Koji Mori, Itami (JP); Masahiro Yamakawa, Osaka (JP); Masayuki Nishizawa, Itami (JP); Takayasu Sugihara, Osaka (JP); Kohji Inokuchi, Itami (JP); Nozomu Kawabe, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 122 days.

(21) Appl. No.: 13/515,169

(22) PCT Filed: Dec. 6, 2010

(86) PCT No.: PCT/JP2010/071849
§ 371 (c)(1),
(2), (4) Date: Jun. 11, 2012

(87) PCT Pub. No.: WO2011/071024
PCT Pub. Date: Jun. 16, 2011

(65) Prior Publication Data

US 2012/0282131 A1 Nov. 8, 2012

(30) Foreign Application Priority Data

Dec. 11, 2009 (JP) ..... 2009-282081
Nov. 22, 2010 (JP) ..... 2010-260382

(51) Int. Cl.

| | |
|---|---|
| ***C22C 23/02*** | (2006.01) |
| ***C22F 1/06*** | (2006.01) |
| ***B22D 11/00*** | (2006.01) |
| ***C22F 1/00*** | (2006.01) |
| ***C23C 22/22*** | (2006.01) |

(52) U.S. Cl.
CPC . *C22C 23/02* (2013.01); *C22F 1/06* (2013.01); *B22D 11/001* (2013.01); *C22F 1/00* (2013.01); *C23C 22/22* (2013.01)
USPC ..... 420/407

(58) Field of Classification Search
USPC ..... 420/407
See application file for complete search history.

(56) References Cited

U.S. PATENT DOCUMENTS 6,139,651 A 10/2000 Bronfin et al.
6,143,097 A * 11/2000 Fujita et al. ..... 148/420

FOREIGN PATENT DOCUMENTS

EP 0 665 299 A1 8/1995
JP H07-224344 A 8/1995

(Continued)

OTHER PUBLICATIONS

Machine translation of JP 2006291327, 2006.*

(Continued)

*Primary Examiner* — Rebecca Lee
(74) *Attorney, Agent, or Firm* — Ditthavong & Steiner, P.C.

(57) ABSTRACT

A magnesium alloy material having excellent impact resistance is provided. The magnesium alloy material is composed of a magnesium alloy that contains more than 7.5% by mass of Al and has a Charpy impact value of 30 J/cm$^2$ or more. Typically, the magnesium alloy material has an elongation of 10% or more at a tension speed of 10 m/s in a high-speed tensile test. The magnesium alloy is composed of a precipitate, typically made of an intermetallic compound containing at least one of Al and Mg, and contains particles having an average particle size of 0.05 μM or more and 1 μm or less dispersed therein. The total area of the particles accounts for 1% by area or more and 20% by area or less. The magnesium alloy material containing fine precipitate particles dispersed therein has high impact absorption capacity through dispersion strengthening and has excellent impact resistance.

15 Claims, 7 Drawing Sheets

(56) References Cited

FOREIGN PATENT DOCUMENTS

| | | | | |
|---|---|---|---|---|
| JP | H09-024338 | A | | 1/1997 |
| JP | H09-024338 | A | | 1/1997 |
| JP | 2006-291327 | A | | 10/2006 |
| JP | 2006-291372 | A | | 10/2006 |
| JP | 2006291327 | A | * | 10/2006 |
| JP | 2007-327115 | A | | 12/2007 |
| JP | 2008-106337 | A | | 5/2008 |
| JP | 2008106337 | A | * | 5/2008 |
| RU | 2213796 | C2 | | 10/2003 |
| WO | WO 2008/029497 | A1 | | 3/2008 |
| WO | WO 2009/001516 | A1 | | 12/2008 |

OTHER PUBLICATIONS

Machine translation of JP 2008106337, 2008.*

Machine translation of JP 09024338, 1997.*

International Search Report for PCT Application No. PCT/JP2010/071849 dated Mar. 8, 2011, p. 1.

English Translation with Russian Decision on Grant for Corresponding Patent Application No. 2012129180 mailed Oct. 10, 2013, pp. 1-11.

Chinese Office Action in corresponding Patent Application No. 201080056199.X, issued on May 6, 2013, 14 pages.

* cited by examiner (I) SUBSTRATE OF SAMPLE No. 1
(MAGNESIUM ALLOY SHEET)

1 μm (II) SUBSTRATE OF SAMPLE No. 110
(MAGNESIUM ALLOY SHEET)

1 μm

MAGNESIUM ALLOY MATERIAL

TECHNICAL FIELD

The present invention relates to a magnesium alloy material suitable for constituent materials of various parts, such as parts of automobiles and housings for mobile electronic devices. In particular, the present invention relates to a magnesium alloy material having excellent impact resistance.

BACKGROUND ART

Light-weight magnesium alloys having excellent specific strength and specific rigidity are being studied as constituent materials of various parts, such as housings for mobile electronic devices, including cellular phones and laptop computers, and parts of automobiles, including wheel covers and paddle shifts. Magnesium alloy parts are mainly made of cast materials manufactured by a die-casting process or a thixomold process (AZ91 alloy as defined in the American Society for Testing and Materials standards). In recent years, parts manufactured by press forming of a sheet made of a wrought magnesium alloy exemplified by AZ31 alloy as defined in the American Society for Testing and Materials standards have been used for parts, such as the housings. Patent Literatures 1 and 2 disclose press forming of a rolled sheet manufactured under particular conditions from AZ91 alloy or an alloy that has substantially the same Al content as AZ91 alloy.

It is believed that magnesium has excellent vibrational energy absorption characteristics. For example, alloys having a reduced Al content and Zn-free alloys, more specifically, AM60 alloy as defined in the American Society for Testing and Materials standards, are used as constituent materials of parts that require high impact strength, such as parts of automobiles.

CITATION LIST

Patent Literature

PTL 1: International Publication NO. 2008/029497
PTL 2: International Publication NO. 2009/001516

SUMMARY OF INVENTION

Technical Problem

It is desirable to develop a magnesium alloy material having higher impact resistance.

Although the AM60 alloy has excellent impact resistance, it is desirable to further improve the impact resistance. Cast materials, such as a die-cast material, of AZ91 alloy tend to have internal defects, such as cavities, locally increased concentrations of Al component, or randomly oriented crystal grains and often have a heterogeneous composition or structure. In such cast materials, such as a die-cast material, of AZ91 alloy, because of a high Al content, undissolved Al tends to precipitate as an intermetallic compound within the grain boundaries. A defective portion or a precipitate within a grain boundary may become a starting point of a fracture, or a portion of the heterogeneous composition or structure may become a mechanically vulnerable point. Thus, the cast materials, such as a die-cast material, of AZ91 alloy have low impact resistance.

Accordingly, it is an object of the present invention to provide a magnesium alloy material having excellent impact resistance.

Solution to Problem

In order to improve the strength of magnesium alloy, the present inventors manufactured sheets of a magnesium alloy that contains more than 7.5% by mass of Al by various methods and examined the impact resistance of the sheets. The present inventors found that the magnesium alloy sheets manufactured under particular conditions had very high impact resistance.

More specifically, in magnesium alloy sheets having high impact resistance, the magnesium alloy contains a certain amount of precipitate, such as an intermetallic compound containing at least one of Mg and Al, including $Mg_{17}Al_{12}$ or $Al_6(MnFe)$. The precipitate had a relatively small particle size, is uniformly dispersed, and is substantially free from coarse particles, for example, having a size of 5 μm or more. Thus, a manufacturing process that can control the size and number of precipitate particles, that is, that can prevent the formation of coarse precipitate particles and produce a certain number of fine precipitate particles was investigated. As a result, the present inventors found that, in manufacturing processes up to the point where the end product is formed after casting, in particular, after solution treatment, it is preferable to control the manufacturing conditions such that a magnesium alloy material is held in a particular temperature range for a given total time.

The present invention is based on these findings. The present invention relates to a magnesium alloy material that is made of a magnesium alloy containing more than 7.5% by mass of Al and has a Charpy impact value of 30 J/cm$^2$ or more.

A magnesium alloy material according to the present invention has very large impact absorption energy, has a Charpy impact value equal to or more than that of AM60 alloy as described below in the test examples, and excellent impact resistance. Thus, when a magnesium alloy material according to the present invention is used as a constituent material of parts that are required to sufficiently absorb impact energy, such as parts of automobiles, the magnesium alloy material is expected to be resistant to cracking under high-speed stress and to be able to sufficiently absorb an impact. Thus, a magnesium alloy material according to the present invention is expected to be suitably used as a constituent material of impact-absorbing members. The impact absorption energy increases with increasing Charpy impact value. Thus, the magnesium alloy material more preferably has a Charpy impact value of 40 J/cm$^2$ or more without an upper limit.

A magnesium alloy material according to the present invention contains a larger amount of Al than AM60 alloy and consequently has higher corrosion resistance than AM60 alloy. In particular, a magnesium alloy material according to the present invention has excellent corrosion resistance also because of its particular structure, as described below.

A magnesium alloy material according to one aspect of the present invention has an elongation of 10% or more at a tension speed of 10 m/s in a high-speed tensile test.

The present inventors surprising obtained the result that a magnesium alloy material according to the present invention has a slightly lower elongation than AM60 alloy in a general tensile test (tension speed: a few millimeters per second) but a higher elongation than AM60 alloy in a very high speed tensile test, for example, at a tension speed of 10 m/s. A magnesium alloy material according to the present invention having such a high elongation in a high-speed tensile test is expected to deform sufficiently upon impact (contact with an object at high speed) and absorb the impact. A higher elongation can result in higher impact resistance. The elongation is preferably 12% or more, more preferably 14% or more, and has no upper limit.

A magnesium alloy material according to one aspect of the present invention has a tensile strength of 300 MPa or more at a tension speed of 10 m/s in a high-speed tensile test.

As described above, a magnesium alloy material according to the present invention has high tenacity with a high elongation in a high-speed tensile test and high strength with a high tensile strength in a high-speed tensile test. Because of high strength and tenacity even under high-speed stress, the magnesium alloy material according to the present aspect is resistant to fracture upon impact, is deformable sufficiently, has high impact absorption capacity, and has excellent impact resistance. The tensile strength is preferably as high as possible, more preferably 320 MPa or more, still more preferably more than 330 MPa, and has no upper limit.

A magnesium alloy material according to another aspect of the present invention has an elongation $EL_{hg}$ at a tension speed of 10 m/s in a high-speed tensile test 1.3 times or more higher than an elongation $EL_{low}$ at a tension speed of 2 mm/s in a low-speed tensile test.

A magnesium alloy material according to this aspect has a high elongation in a high-speed tensile test and a large difference in elongation between the high-speed tensile test and the low-speed tensile test. As described below in the test examples, AM60 alloy has a high elongation in a high-speed tensile test but little difference in elongation between the high-speed tensile test and a low-speed tensile test. In contrast, as described above, a magnesium alloy material according to the present aspect has a high absolute elongation in the high-speed tensile test and a large difference in elongation between the high-speed tensile test and the low-speed tensile test and is therefore sufficiently deformable upon impact. Thus, a magnesium alloy material according to the present aspect has excellent impact resistance. Depending on the composition and the structure, a magnesium alloy material according to the present aspect may be configured to satisfy $EL_{hg} \leq 1.5 \times EL_{low}$.

In accordance with still another aspect of the present invention, the magnesium alloy contains precipitate particles dispersed therein, the precipitate particles have an average particle size of 0.05 μM or more and 1 μM or less, and the total area of the precipitate particles in a cross section of the magnesium alloy material accounts for 1% or more and 20% or less of the cross section.

A magnesium alloy material according to the present aspect is substantially free from coarse precipitate particles and contains very fine precipitate particles dispersed therein. The dispersion of fine precipitate particles can improve the rigidity of a sheet through dispersion strengthening. Thus, a magnesium alloy material according to the present invention is rarely dented by impacts and has excellent impact resistance. This can reduce a decrease in the amount of Al dissolved in the magnesium alloy resulting from the presence of coarse precipitate particles or excessive precipitation and reduce the deterioration in the strength of the magnesium alloy resulting from a decrease in the amount of dissolved Al, and the desired strength is attained. Thus, a magnesium alloy material according to the present invention has excellent impact resistance. Hence, a magnesium alloy material having the particular structure according to the present invention has excellent impact resistance. In accordance with the present aspect, the presence of few coarse precipitate particles results in excellent plastic formability and facilitates press forming.

In accordance with still another aspect of the present invention, the precipitate particles include particles made of an intermetallic compound containing at least one of Al and Mg.

The intermetallic compound tends to have higher corrosion resistance than magnesium alloy. Thus, in accordance with present aspect, in addition to the improvement of impact resistance through dispersion strengthening of the precipitate, the presence of the intermetallic compound having excellent corrosion resistance improves corrosion resistance.

Advantageous Effects of Invention

A magnesium alloy material according to the present invention has excellent impact resistance.

BRIEF DESCRIPTION OF DRAWINGS

FIG. 6(I) shows a sample No. 1, and FIG. 6(II) shows a sample No. 110.

FIG. 7(I) shows the sample No. 1 (×250,000), and FIG. 7(II) shows the sample No. 110 (×100,000).

DESCRIPTION OF EMBODIMENTS

Figure 1:
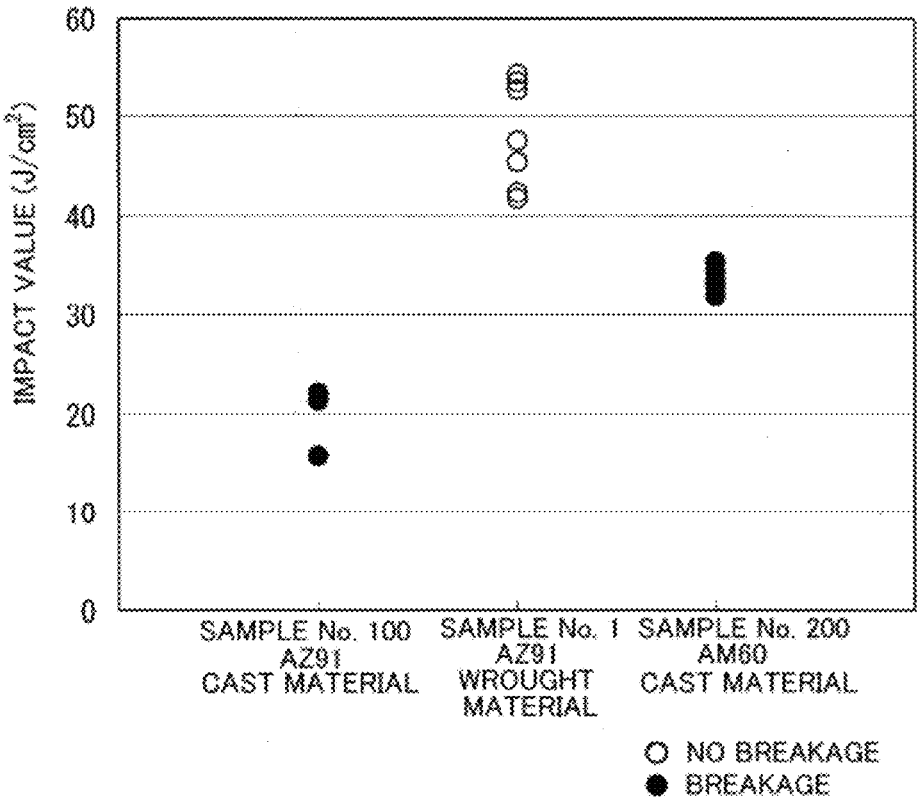
FIG. 1 is a graph of the Charpy impact value of a magnesium alloy material.

The present invention will be described in detail below.

[Magnesium Alloy Material]

(Composition)

A magnesium alloy constituting a magnesium alloy material according to the present invention may have a composition in which Mg is combined with an additive element (the remainder: Mg and impurities, Mg: 50% by mass or more). In particular, in the present invention, the magnesium alloy is a Mg—Al alloy in which the additive element contains at least more than 7.5% by mass of Al. More than 7.5% by mass of Al can improve not only the mechanical characteristics, such as strength and plastic deformation resistance, but also the corrosion resistance of the magnesium alloy. The mechanical characteristics, such as strength, and the corrosion resistance tend to increase with the Al content. However, more than 12% by mass of Al results in poor plastic formability and requires heating of the material during rolling. Thus, the Al content is preferably 12% by mass or less.

The additive element other than Al may be one or more elements selected from the group consisting of Zn, Mn, Si, Ca, Sr, Y, Cu, Ag, Be, Sn, Li, Zr, Ce, Ni, Au, and rare-earth elements (except Y and Ce). Each of the elements may constitute 0.01% by mass or more and 10% by mass or less, preferably 0.1% by mass or more and 5% by mass or less, of the magnesium alloy. For example, specific Mg—Al alloy may be AZ alloy (Mg—Al—Zn alloy, Zn: 0.2% to 1.5% by mass), AM alloy (Mg—Al—Mn alloy, Mn: 0.15% to 0.5% by mass), Mg—Al-RE (rare-earth element) alloy, AX alloy (Mg—Al—Ca alloy, Ca: 0.2% to 6.0% by mass), or AJ alloy (Mg—Al—Sr alloy, Sr: 0.2% to 7.0% by mass) as defined in the American Society for Testing and Materials standards. In particular, 8.3% to 9.5% by mass of Al can improve both strength and corrosion resistance. More specific example is a Mg—Al alloy that contains 8.3% to 9.5% by mass of Al and 0.5% to 1.5% by mass of Zn, typically AZ91 alloy. 0.001% by mass or more in total, preferably 0.1% by mass or more and 5% by mass or less in total, of at least one element selected from Y, Ce, Ca, and rare-earth elements (except Y and Ce) can improve heat resistance and flame resistance.

(Structure: Precipitate)

The magnesium alloy contains fine precipitate particles, for example, having an average particle size in the range of 0.05 μm to 1 μm dispersed therein. The precipitate particles in a cross section of the magnesium alloy material constitute 1% to 20% by area of the magnesium alloy material. The precipitate particles may be particles that contain an additive element in a magnesium alloy, typically, particles made of an intermetallic compound containing Mg or Al, more specifically, $Mg_{17}Al_{12}$ (not particularly limited to $Mg_{17}Al_{12}$). When the average particle size is 0.05 μM or more and when the precipitate content is 1% by area or more, the magnesium alloy can contain a sufficient number of precipitate particles and have excellent impact resistance through dispersion strengthening of the precipitate particles. When the average particle size of the precipitate particles is 1 μm or less and when the precipitate content is 20% by area or less, the magnesium alloy does not contain excess precipitate particles or coarse precipitate particles. This prevents a decrease in the amount of dissolved Al and secures strength. The average particle size is more preferably 0.1 μm or more and 0.5 μm or less, and the precipitate content is more preferably 3% by area or more and 15% by area or less, still more preferably 12% by area or less, still more preferably 5% by area or more and 10% by area or less.

(Form)

A magnesium alloy material according to the present invention is typically a rectangular sheet (magnesium alloy sheet) and may have various shapes, such as rectangular and circular. The sheet may be a coiled sheet of a continuous long sheet or a short sheet having a predetermined length and shape. The sheet may have a boss or a through-hole from the front side to the back side. The sheet may have any form depending on the manufacturing processes. For example, the form may be a rolled sheet, a heat-treated or straightened sheet manufactured by heat treatment or straightening of a rolled sheet as described below, or a polished sheet manufactured by polishing of the rolled, heat-treated, or straightened sheet. A magnesium alloy material according to the present invention may be a formed product manufactured by plastic forming, such as press forming, including bending and drawing, of the sheet. The magnesium alloy material may have any form, size (area), or thickness depending on its desired application. In particular, a magnesium alloy material having a thickness of 2.0 mm or less, preferably 1.5 mm or less, more preferably 1 mm or less, can be suitably used for thin and light-weight parts (typically, housings and parts of automobiles).

The formed product may have any shape and size, for example, a box or frame having a U-shaped cross section that includes a top (a bottom) and a sidewall extending perpendicularly from the top (bottom) or a covered tube that includes a discoidal top and a cylindrical sidewall. The top may have an integral or attached boss, a through-hole from the front side to the back side, a groove in the thickness direction, a step, or a portion having a different thickness formed by plastic forming or cutting. A magnesium alloy material according to the present invention may partly have a portion formed by plastic forming, such as press forming. In the case that a magnesium alloy material according to the present invention is the formed product or has a portion formed by plastic forming, a portion having less plastic deformations (typically, a flat portion) substantially retains the structure and mechanical characteristics of a sheet (magnesium alloy sheet) that has been used as the material for the plastic forming. Thus, in the measurement of the mechanical characteristics, such as the Charpy impact value and the elongation, of the formed product or a magnesium alloy material having a portion formed by plastic forming, test specimens are taken from the portion having less plastic deformations.

(Mechanical Characteristics)

The main feature of a magnesium alloy material according to the present invention is that the magnesium alloy material has a Charpy impact value, an elongation in a high-speed tensile test, and a tensile strength equal to or more than those of AM60 alloy, as described above. In particular, a test specimen of a magnesium alloy material according to the present invention is not broken (fractured) but bends in a Charpy impact test, that is, under high-speed stress, as described below in the test examples. Upon impact, a magnesium alloy material according to the present invention can undergo sufficient plastic deformation and thereby absorb impact energy. Thus, a magnesium alloy material according to the present invention used as a constituent material of a part of an automobile, such as a chassis or a bumper, is expected to protect an occupant in the automobile.

[Magnesium Alloy Structural Member]

A magnesium alloy material according to the present invention can be used to manufacture a magnesium alloy structural member having an anticorrosive layer formed by surface treatment, such as chemical conversion treatment or anodizing. The magnesium alloy structural member includes the anticorrosive layer as well as a magnesium alloy material having excellent corrosion resistance and consequently has further improved corrosion resistance. The present inventors found that chemical conversion treatment of a magnesium alloy material having the particular structure described above sometimes produced an anticorrosive layer having a particular structure (two-layer structure). A magnesium alloy structural member that included an anticorrosive layer having the particular structure had excellent corrosion resistance. The specific structure of the anticorrosive layer is a two-layer structure that includes a lower sublayer adjacent to the magnesium alloy material and a surface sublayer formed on the lower sublayer. The surface sublayer is denser than the lower sublayer, and the lower sublayer is a porous layer. The anticorrosive layer is very thin; the anticorrosive layer having the two-layer structure has a total thickness of 50 nm or more and 300 nm or less (the lower sublayer constitutes approximately 60% to 75% of the thickness).

[Manufacturing Processes]

In the case that a magnesium alloy material having the particular structure according to the present invention is a sheet, the sheet can be manufactured by a method for manufacturing a magnesium alloy sheet including the following processes.

Preparation process: a process of preparing a cast sheet made of a magnesium alloy that contains more than 7.5% by mass of Al and manufactured by a continuous casting process.

Solution process: a process of performing solution treatment of the cast sheet at a temperature of 350° C. or more to manufacture a solid solution sheet.

Rolling process: a process of performing warm rolling of the solid solution sheet to manufacture a rolled sheet.

In particular, in manufacturing processes after the solution process, the thermal history of a material sheet to be processed (typically a rolled sheet) is controlled such that the total time of holding the material sheet at a temperature of 150° C. or more and 300° C. or less is 0.5 hours or more and less than 12 hours and that the material sheet is not heated to a temperature of more than 300° C.

The manufacturing processes may further include a straightening process of straightening the rolled sheet. The straightening process may involve straightening while the rolled sheet is heated at a temperature of 100° C. or more and 300° C. or less, that is, warm straightening. In this case, the total time includes the time of holding the rolled sheet at a temperature of 150° C. or more and 300° C. or less in the straightening process.

A formed product of a magnesium alloy material according to the present invention or a magnesium alloy material according to the present invention having a portion formed by plastic forming can be manufactured by a method that includes the preparation of a rolled sheet formed by the method for manufacturing a magnesium alloy sheet described above or a straightened sheet formed by the straightening process as a base material and a plastic forming process of performing plastic forming of the base material. A magnesium alloy structural member that includes a magnesium alloy material according to the present invention and the anticorrosive layer can be manufactured by a method that includes a surface treatment process of performing corrosion protection, such as chemical conversion treatment or anodizing, on a material subjected to the plastic forming. Like the manufacturing processes described above, the plastic forming process before the surface treatment process can prevent an anticorrosive layer formed by surface treatment from being damaged by plastic forming. The corrosion protection may be performed on a material before the plastic forming. In this case, the method for manufacturing a magnesium alloy structural member may include a process of preparing a rolled sheet or a straightened sheet as a base material, a process of performing corrosion protection on the base material, and a process of performing the plastic forming after the corrosion protection. In these manufacturing processes, a target of corrosion protection, such as a sheet, has a flat shape and is easily subjected to corrosion protection.

In the manufacture of a magnesium alloy material according to the present invention, solution treatment allows Al to be sufficiently dissolved in the magnesium alloy, as described above. In the manufacturing processes after the solution treatment, the magnesium alloy material is held in a particular temperature range (150° C. to 300° C.) for a particular time range such that a predetermined amount of precipitate can be easily precipitated. Furthermore, the holding time in the particular temperature range can be controlled so as to prevent the excessive growth of the precipitate and allow fine precipitate particles to be dispersed.

In the case that rolling is performed more than once (multipass) with an appropriate degree of processing (rolling reduction) to achieve a desired sheet thickness in the rolling process, a target to be processed (a material after the solution treatment; for example, a rolled sheet before the final rolling) can be heated to a temperature of more than 300° C. so as to improve plastic formability and facilitate rolling. With an Al content as high as more than 7.5% by mass, however, heating to a temperature of more than 300° C. may accelerate the precipitation of an intermetallic compound or the growth of a precipitate to form coarse particles. The excessive production or growth of the precipitate results in a decrease in the amount of dissolved Al in the magnesium alloy. A decrease in the amount of dissolved Al results in low strength or corrosion resistance of the magnesium alloy. With a decrease in the amount of dissolved Al, it is difficult to further improve the corrosion resistance even by the formation of an anticorrosive layer.

Furthermore, in order to improve press formability through recrystallization or remove strain resulting from plastic forming, heat treatment is generally performed during or after rolling or after plastic forming, such as press forming. The heat treatment temperature tends to be increased with the Al content. For example, Patent Literature 1 proposes heat treatment of AZ91 alloy after rolling (the final annealing) at a temperature in the range of 300° C. to 340° C. Heat treatment at a temperature of more than 300° C. also accelerates the growth of a precipitate to form coarse particles. Thus, the thermal history of the material sheet should be controlled in the processes after the solution process.

Each of the processes will be described in detail below.

(Preparation Process)

The cast sheet is preferably manufactured by a continuous casting process, such as a twin-roll process, in particular, a casting process described in WO 2006-003899. The continuous casting process can reduce the formation of oxides and segregation by means of rapid solidification and prevent the formation of coarse impurities in crystal and precipitated impurities having a size of more than 10 μm, which can be starting points of cracking. Thus, the cast sheet has excellent rollability. Although the cast sheet may have any size, an excessive thickness may result in segregation. Thus, the cast sheet preferably has a thickness of 10 mm or less, more preferably 5 mm or less. In particular, in the manufacture of a coiled long cast sheet even having a small diameter, the long cast sheet can be wound without causing a crack when a portion of the long cast sheet just before coiling is heated to 150° C. or more. A coiled long cast sheet having a large diameter may be wound at low temperature.

(Solution Process)

The cast sheet is subjected to solution treatment to make its composition uniform and manufacture a solid solution sheet containing an element, such as Al, dissolved therein. The solution treatment is preferably performed at a holding temperature of 350° C. or more, more preferably in the range of 380° C. to 420° C., at a holding time in the range of 60 to 2400 minutes (1 to 40 hours). The holding time is preferably increased as the Al content increases. In a cooling process after the holding time has passed, forced cooling, such as water cooling or air blast, is preferably used to increase the cooling rate (for example, 50° C./min or more), because this can reduce the precipitation of coarse precipitate particles.

(Rolling Process)

In the rolling process of the solid solution sheet, the material (the solid solution sheet or a sheet during rolling) can be heated to improve plastic formability. Thus, at least one pass of warm rolling is performed. However, an excessively high heating temperature results in an excessively long holding time at a temperature in the range of 150° C. to 300° C., which may cause excessive growth or precipitation of a precipitate as described above, the seizure of the material, or a deterioration of the mechanical characteristics of a rolled sheet because of the coarsening of crystal grains in the material. Thus, also in the rolling process, the heating temperature is 300° C. or less, preferably 150° C. or more and 280° C. or less. Rolling the solid solution sheet more than once (multipass) can achieve a desired sheet thickness, decrease the average grain size of the material (for example, 10 μm or less), or improve plastic formability in rolling or press forming. The rolling may be performed under known conditions. For example, not only the material but also a reduction roll may be heated, or the rolling may be combined with non-preheat rolling or controlled rolling as disclosed in Patent Literature 1. Rolling with a small rolling reduction, such as finish rolling, may be performed at low temperature. Use of a lubricant in the rolling process can decrease frictional resistance during rolling and prevent the seizure of the material, thus facilitating rolling.

In multi-pass rolling, an intermediate heat treatment between passes may be performed provided that the holding time at a temperature in the range of 150° C. to 300° C. is included in the total time described above. Removal or reduction of strain, residual stress, or a texture introduced during plastic forming (mainly rolling) before the intermediate heat treatment into a material to be processed can prevent accidental cracking, strain, or deformation during the subsequent rolling, thus facilitating rolling. Also in the intermediate heat treatment, the holding temperature is 300° C. or less, preferably 250° C. or more and 280° C. or less.

(Straightening Process)

A rolled sheet manufactured in the rolling process may be subjected to the final heat treatment (the final annealing) as described in Patent Literature 1. However, warm straightening described above is preferable to the final heat treatment in terms of plastic formability in press forming. Straightening may be performed by heating the rolled sheet to a temperature in the range of 100° C. to 300° C., preferably 150° C. or more and 280° C. or less, with a roller leveler that includes a plurality of staggered rollers as described in Patent Literature 2. Plastic forming, such as press forming, of a straightened sheet after warm straightening causes dynamic recrystallization, which improves plastic formability. Reduction in the thickness of a material by means of rolling can greatly decrease the holding time in the straightening process. For example, depending on the thickness of a material, the holding time may be a few minutes or even less than one minute.

(Plastic Forming Process)

Plastic forming, such as press forming, of the rolled sheet, a heat-treated sheet formed by the final heat treatment of the rolled sheet, a straightened sheet formed by the straightening of the rolled sheet, or a polished sheet formed by polishing (preferably wet polishing) of the rolled sheet, heat-treated sheet, or straightened sheet is preferably performed at a temperature in the range of 200° C. to 300° C. to improve plastic formability of the material. The time of holding a material at a temperature in the range of 200° C. to 300° C. in plastic forming is very short, for example, less than 60 seconds in certain press forming. Such a very short holding time causes substantially no failure, such as coarsening of a precipitate.

Heat treatment after plastic forming can remove strain or residual stress caused by the plastic forming and improve the mechanical characteristics of the sheet. The heat-treatment conditions include a heating temperature in the range of 100° C. to 300° C. and a heating time in the range of approximately 5 to 60 minutes. The holding time at a temperature in the range of 150° C. to 300° C. in the heat treatment is included in the total time described above.

(Total Time of Holding Material in Particular Temperature Range)

The main features of processes up to the process of producing the end product after the solution process in the manufacture of a magnesium alloy material having the particular structure according to the present invention are that the total time of holding a material at a temperature of 150° C. or more and 300° C. or less is controlled in the range of 0.5 to 12 hours and that the material is not heated to a temperature of more than 300° C. For a magnesium alloy having an Al content of more than 7.5% by mass, the total time of holding a material at a temperature in the range of 150° C. to 300° C. in processes up to the process of producing the end product after solution treatment has not sufficiently been studied. As described above, the holding time in a temperature range in which a precipitate is easily formed or a product easily grows can be controlled in a particular range to provide a magnesium alloy material according to the present invention that contains a certain number of fine precipitate particles dispersed therein.

When the total time of holding at a temperature in the range of 150° C. to 300° C. is less than 0.5 hours, a precipitate is not sufficiently precipitated. A total time of more than 12 hours or rolling of a material at a temperature of more than 300° C. results in the formation of coarse precipitate particles having a particle size of 1 μm or more or an excessive amount, for example, more than 20% by area, of precipitate. Preferably, the degree of processing in each pass in the rolling process, the total degree of processing in the rolling process, the conditions for intermediate heat treatment, and the conditions for straightening are controlled such that the temperature range is 150° C. or more and 280° C. or less and that the total time is one hour or more and 6 hours or less. Since the precipitate increases with increasing Al content, the total time is preferably controlled also in a manner that depends on the Al content.

(Surface Treatment Process)

The chemical conversion treatment may be performed appropriately using a known chemical conversion treatment liquid under known conditions. A chromium-free treatment liquid, such as a manganese and calcium phosphate solution, is preferably used in the chemical conversion treatment.

Coating after corrosion protection, such as the chemical conversion treatment or anodizing, for the purpose of protection or ornamentation can further improve corrosion resistance or increase commercial value.

Specific embodiments of the present invention will be described below with reference to test examples.

TEST EXAMPLE 1

A magnesium alloy material was prepared, and the impact resistance and the mechanical characteristics of the magnesium alloy material were measured.

[Sample No. 1]

A magnesium alloy material of sample No. 1 is a sheet (magnesium alloy sheet) prepared by the processes of casting, solution treatment, (warm) rolling, and (warm) straightening in this order.

In this test, a long cast sheet (having a thickness of 4 mm) that was made of a magnesium alloy having a composition corresponding to AZ91 alloy and was formed by a twin-roll continuous casting process was wound to prepare a coiled cast material. The coiled cast material was subjected to solution treatment in a batch furnace at 400° C. for 24 hours. The solid solution coiled material after the solution treatment was unwound and was rolled more than once under the following rolling conditions to a thickness of 2.5 mm. The rolled sheet was wound to prepare a coiled rolled material (length: 400 m).

(Rolling Conditions)

Degree of processing (rolling reduction): 5%/pass to 40%/pass

Heating temperature of sheet: 250° C. to 280° C.

Roll temperature: 100° C. to 250° C.

For the sample No. 1, in each pass of the rolling process, the heating time of a material to be rolled and the rolling speed (roll peripheral speed) were adjusted so as to control the total time of holding the material at a temperature in the range of 150° C. to 300° C. The material was not heated to more than 300° C.

The coiled rolled material was unwound and was subjected to warm straightening. The straightened sheet was wound to prepare a coiled straightened material. The warm straightening was performed using distortion means described in Patent Literature 2 while the rolled sheet was heated to 220° C. The temperature was controlled such that the total time of holding a material at a temperature in the range of 150° C. to 300° C. after the solution process and before the straightening process was in the range of 0.5 to 12 hours. The composition analysis of the straightened sheet showed Al: 8.79%, Zn: 0.64%, and Mn: 0.18% (based on mass), and the remainder: Mg and impurities, which corresponded to the composition of AZ91 alloy. The long straightened sheet (coiled material) was cut into a plurality of short sheets having an appropriate length. The short sheets were cut into test specimens for the tests described below.

[Sample Nos. 100 and 200]

Commercially available sheets AZ91 alloy material (a cast material having a thickness of 2.1 mm: sample No. 100) and AM60 alloy material (a cast material having a thickness of 2.4 mm: sample No. 200) were prepared as comparative samples. The composition analysis of the commercially available materials showed Al: 8.89%, Zn: 0.73%, and Mn: 0.24% (based on mass), and the remainder: Mg and impurities for the AZ91 alloy material, and Al: 6.00% and Mn: 0.3% (based on mass), and the remainder: Mg and impurities for the AM60 alloy material. A plurality of sheets having each of the compositions were prepared. The sheets were cut into test specimens for the tests described below.

[Charpy Impact Value]

The impact values of the magnesium alloy material of the sample No. 1 (hereinafter also referred to as an AZ91 wrought material), the AZ91 cast material of the sample No. 100, and the AM60 cast material of the sample No. 200 were measured in a Charpy impact test. Table I and FIG. 1 show the results.

A commercial testing machine was used in the Charpy impact test. Test specimens having a width of approximately 9 mm and a length in the range of 75 to 80 mm (thickness: 2.1 to 2.5 mm) were cut from each sample sheet. A test specimen was placed in the testing machine such that the longitudinal direction of the test specimen is perpendicular to the swing direction of the hammer.

[Elongation, Tensile Strength, and 0.2% Proof Stress]

Figure 2:
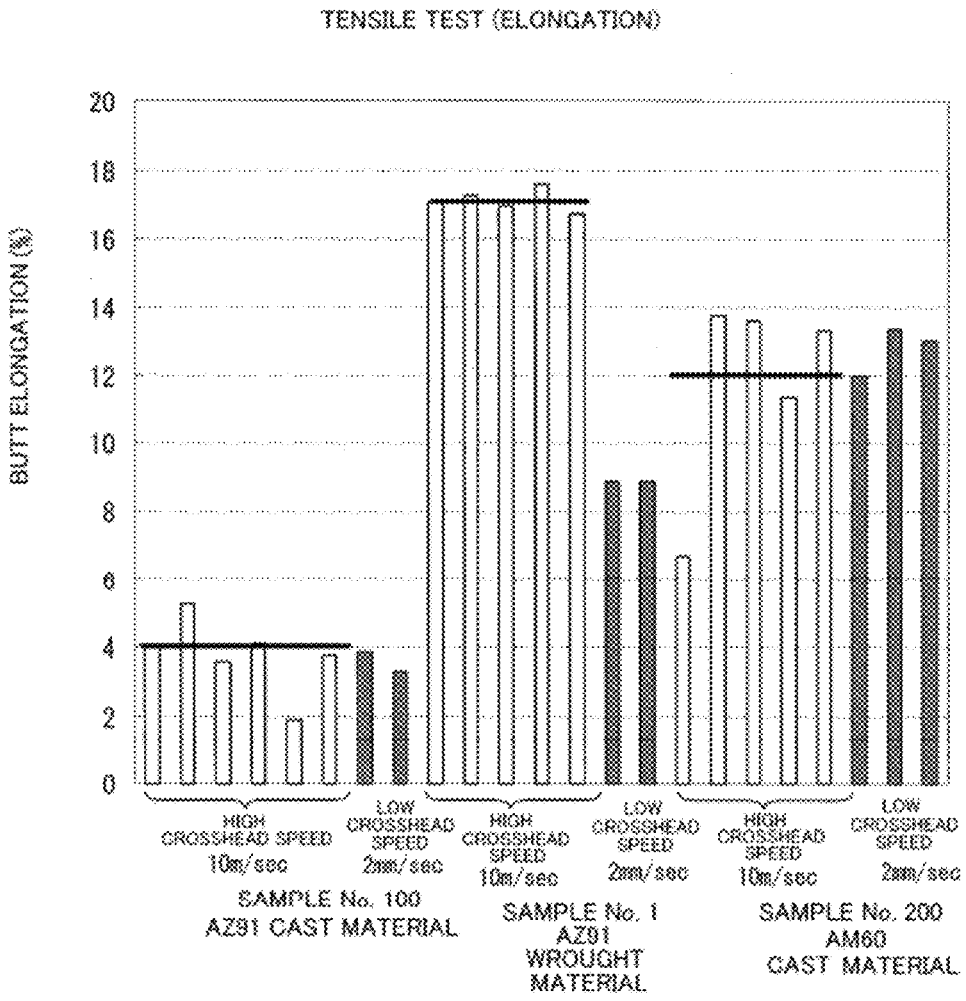
FIG. 2 is a graph of the elongation of a magnesium alloy material in a high-speed tensile test and a low-speed tensile test.
Figure 3:
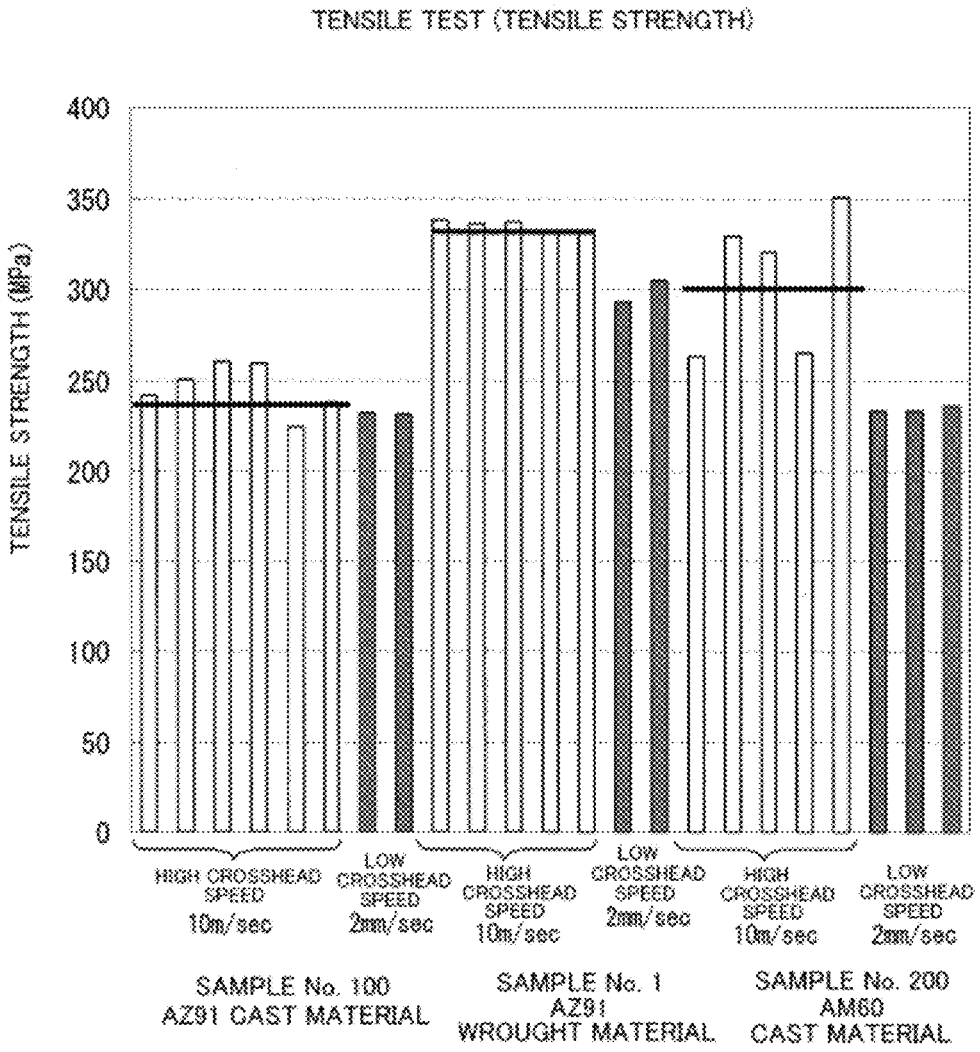
FIG. 3 is a graph of the tensile strength of a magnesium alloy material in a high-speed tensile test and a low-speed tensile test.
Figure 4:
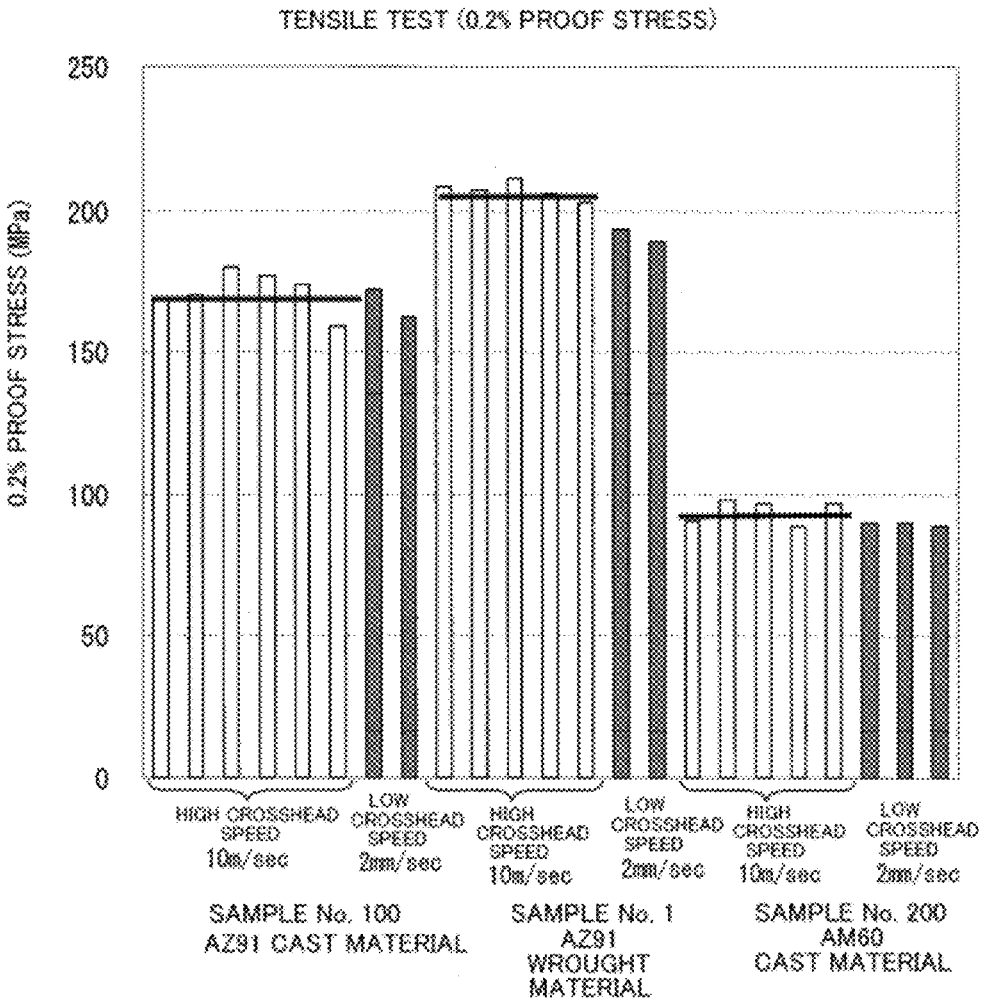
FIG. 4 is a graph of the 0.2% proof stress of a magnesium alloy material in a high-speed tensile test and a low-speed tensile test.

The elongation, tensile strength, and 0.2% proof stress of the AZ91 wrought material of the sample No. 1, the AZ91 cast material of the sample No. 100, and the AM60 cast material of the sample No. 200 were measured in a high-speed tensile test and a low-speed tensile test. Table II and FIGS. 2 to 4 show the results. In FIGS. 2 to 4, the white bars indicate the results in the high-speed tensile test, hatched bars indicate the results in the low-speed tensile test, and horizontal thick lines on the bars indicate mean values.

Figure 5:
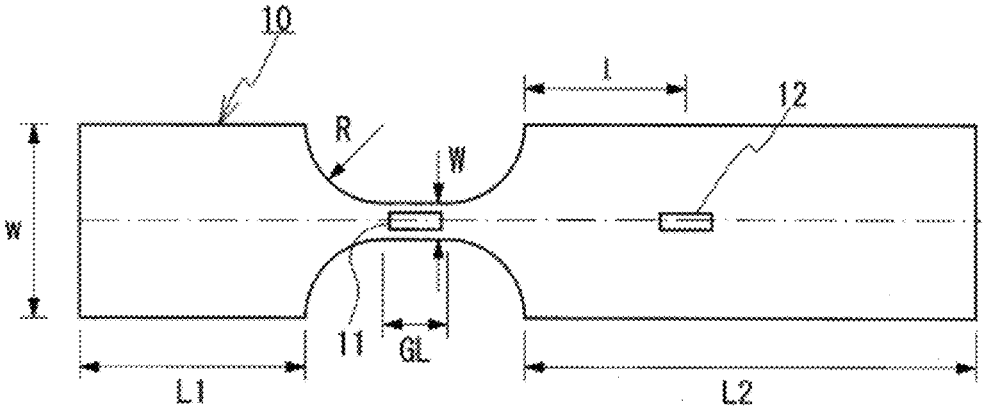
FIG. 5 is a plan view of a test specimen used in a high-speed tensile test.

The high-speed tensile test was performed with a commercial testing machine (a hydraulic servo high-speed tensile tester manufactured by Shimadzu Corp.) that can apply tension at high speed. A test specimen 10 having a narrow portion illustrated in FIG. 5 was cut from a sample sheet with reference to JIS Z 2201 (1998) and was placed in the testing machine. A plastic strain gage 11 was attached to the front and back sides of the narrow portion of the test specimen 10 to measure plastic strain (permanent strain). An elastic strain gage 12 was attached onto a center line on a surface of the test specimen 10 at 1=25 mm from a point of intersection between a shoulder and a parallel portion to convert a measured value into load (stress). In the test specimen 10, the gauge mark distance GL was 10 mm, the narrow portion had a width W of 4.3 mm, the chuck lengths were L1=35 mm and L2=70 mm, the test specimen width w was 20 mm, and the shoulder radius R was 10 mm. The test conditions included a tension speed (target value) of 10 m/s, a strain rate (target value) of 1000/sec, ambient atmosphere, and room temperature (approximately 20° C.). The longitudinal direction of the test specimen 10 was parallel to the rolling direction (the traveling direction of the rolled sheet). The tensile strength (MPa), 0.2% proof stress (MPa), and elongation (MPa) were measured in the high-speed tensile test.

The low-speed tensile test was performed with a commercial testing machine in accordance with JIS Z 2241 (1998). The test conditions included a tension speed (target value) of 2 mm/s, a strain rate (target value) of 0.2/sec, ambient atmosphere, and room temperature (approximately 20° C.). The tensile strength (MPa), 0.2% proof stress (MPa), and elongation (MPa) were measured in the low-speed tensile test. In the low-speed tensile test, the load (stress) was measured with a load cell of the testing machine.

Table III shows the relationship in elongation, tensile strength, and 0.2% proof stress between the samples on the basis of the results in the high-speed tensile test and the low-speed tensile test.

The corrosion resistance of the samples was evaluated in a corrosion resistance test. A 5% by mass aqueous NaCl solution was prepared as a corrosive liquid. A test specimen was cut from a sample sheet and was masked such that the exposed area was 4 $cm^2$. The test specimen was completely immersed in 50 mL of the aqueous NaCl solution for 96 hours (at room temperature (25±2° C.) under air conditioning). After immersion for 96 hours, the test specimen was removed from the aqueous NaCl solution, and the number of Mg ions that dissolved in the aqueous NaCl solution was measured with an ICP spectroscopy (ICP-AES). The number of Mg ions was divided by the exposed area to calculate the corrosion loss ($\mu g/cm^2$). Table I shows the results.

TABLE I

| Material | Sample No. | Impact value $J/cm^2$ | Corrosion loss $\mu g/cm^2$ |
|---|---|---|---|
| AZ91 cast material | 100-1 | 22.2 | 850 |
| | 100-2 | 15.7 | |
| | 100-3 | 21.4 | |
| | 100-4 | 21.3 | |
| | Average | 21.6 | |
| AZ91 wrought material | 1-1 | 41.7 | 642 |
| | 1-2 | 54.4 | |
| | 1-3 | 53.6 | |
| | 1-4 | 42.3 | |
| | 1-5 | 45.3 | |
| | 1-6 | 47.5 | |
| | 1-7 | 52.9 | |
| | Average | 47.0 | |
| AM60 cast material | 200-1 | 35.4 | 1600 |
| | 200-2 | 31.9 | |
| | 200-3 | 33.1 | |
| | 200-4 | 33.4 | |
| | 200-5 | 34.5 | |
| | 200-6 | 32.9 | |
| | Average | 33.5 | |

TABLE II

| Material | Sample No. | Tension speed (m/sec) | 0.2% proof stress (MPa) | Tensile strength (MPa) | Butt elongation (%) (G.L. = 10 mm) |
|---|---|---|---|---|---|
| AZ91 cast material | 100-11 | 10 | 169 | 242 | 4.1 |
| | 100-12 | High speed | 170 | 251 | 5.2 |
| | 100-13 | | 180 | 260 | 3.6 |
| | 100-14 | | 177 | 259 | 4.1 |
| | 100-15 | | 174 | 225 | 1.9 |
| | 100-16 | | 159 | 238 | 3.7 |
| | High speed average | | 172 | 246 | 4 |
| | 100-21 | 0.002 | 172 | 232 | 3.9 |
| | 100-22 | Low speed | 162 | 231 | 3.3 |
| AZ91 wrought material | 1-11 | 10 | 208 | 338 | 17.1 |
| | 1-12 | High speed | 207 | 336 | 17.3 |
| | 1-13 | | 211 | 337 | 16.9 |
| | 1-14 | | 206 | 333 | 17.6 |
| | 1-15 | | 203 | 332 | 16.7 |
| | High speed average | | 207 | 335 | 17 |
| | 1-21 | 0.002 | 193 | 293 | 8.8 |
| | 1-22 | Low speed | 189 | 305 | 8.9 |
| AM60 cast material | 200-11 | 10 | 91 | 263 | 6.7 |
| | 200-12 | High speed | 98 | 330 | 13.7 |
| | 200-13 | | 97 | 321 | 13.6 |
| | 200-14 | | 89 | 265 | 11.4 |
| | 200-15 | | 97 | 351 | 13.3 |
| | High speed average | | 94 | 306 | 12 |
| | 200-21 | 0.002 | 90 | 233 | 12.0 |
| | 200-22 | Low speed | 90 | 233 | 13.4 |
| | 200-23 | | 89 | 236 | 13.0 |

TABLE III

| | Low speed | High speed |
|---|---|---|
| Tensile strength | AZ91 cast < AM60 cast < AZ91 wrought | AZ91 cast < AM60 cast < AZ91 wrought |
| 0.2% proof stress | AM60 cast < AZ91 cast < AZ91 wrought | AM60 cast < AZ91 cast < AZ91 wrought |
| Elongation | AZ91 cast < AZ91 wrought < AM60 cast | AZ91 cast < AM60 cast < AZ91 wrought |

Table I shows that the AZ91 wrought material of the sample No. 1, which was made of a magnesium alloy containing more than 7.5% by mass of Al and was prepared by rolling and controlling the thermal history, had a very high Charpy impact value of 30 J/cm$^2$ or more or 40 J/cm$^2$ or more. The AZ91 wrought material of the sample No. 1 had a larger Charpy impact value than the AM60 cast material of the sample No. 200. In the Charpy impact test, the impact value was generally measured up to the point where a test specimen was broken (fractured). However, upon a stronger impact, the test specimen of the AZ91 wrought material of the sample No. 1 was not fractured but was bent and fell out of the support of the testing machine. Thus, a stronger impact could not be properly applied. Table I shows the maximum impact value at which the test specimen did not fall out of the support. The AZ91 wrought material of the sample No. 1 had an impact value of at least the value listed in Table I and is expected to have excellent impact resistance.

In contrast, the AZ91 cast material of the sample No. 100, which had substantially the same components as the sample No. 1, had a small Charpy impact value of less than 30 J/cm$^2$. Thus, even with substantially the same components, the impact value may be different when the manufacturing processes were different.

Table II shows that the AZ91 wrought material of the sample No. 1 had high elongation, tensile strength, and 0.2% proof stress in the high-speed tensile test. The elongation, tensile strength, and 0.2% proof stress in the high-speed tensile test of the AZ91 wrought material of the sample No. 1 were higher than those of the AZ91 cast material of the sample No. 100 and the AM60 cast material of the sample No. 200. The AZ91 wrought material of the sample No. 1 had high strength and tenacity in the high-speed tensile test.

FIGS. 2 to 4 show that the AZ91 wrought material of the sample No. 1 had large absolute mean values of elongation, tensile strength, and 0.2% proof stress with small variations in the high-speed tensile test. Thus, although the long coiled material, the AZ91 wrought material of the sample No. 1 had uniform characteristics.

The elongation of the AZ91 cast material of the sample No. 100 and the AM60 cast material of the sample No. 200 had little difference between the high-speed tensile test and the low-speed tensile test. In contrast, the AZ91 wrought material of the sample No. 1 had a very large difference between the elongation $EL_{gh}$ (mean value) in the high-speed tensile test and the elongation $EL_{low}$ in the low-speed tensile test. The elongation $EL_{gh}$, in the high-speed tensile test was 1.3 times or more higher than $EL_{low}$ (approximately twice). Such a much higher elongation in the high-speed tensile test probably contributes to improved impact resistance.

One reason for the excellent impact resistance of the AZ91 wrought material of the sample No. 1 is probably that the AZ91 wrought material contained uniformly dispersed fine precipitate particles, for example, made of an intermetallic compound. The metallographic structure will be described below.

Even without corrosion protection, such as chemical conversion treatment, the AZ91 wrought material of the sample No. 1 had excellent corrosion resistance. In particular, although the AZ91 wrought material of the sample No. 1 had substantially the same components (element contents) as the AZ91 cast material of the sample No. 100, the AZ91 wrought material of the sample No. 1 had better corrosion resistance than the AZ91 cast material of the sample No. 100. The better corrosion resistance is partly because of the particular structure.

TEST EXAMPLE 2

A substrate of a magnesium alloy sheet was subjected to chemical conversion treatment to prepare a magnesium alloy structural member having an anticorrosive layer. The metallographic structure of the substrate, the morphology of the anticorrosive layer, and corrosion resistance were examined.

[Sample No. 1]

A magnesium alloy structural member of the sample No. 1 is prepared by the processes of casting, solution treatment, (warm) rolling, (warm) straightening, polishing, and the formation of an anticorrosive layer in this order. The basic manufacturing processes and manufacturing conditions of a magnesium alloy sheet were the same as the test example 1. Unlike the magnesium alloy material prepared in the test example 1, a sheet rather than a coiled material was prepared in the test example 2, and an anticorrosive layer was formed on the sheet.

In this test, a plurality of cast sheets (having a thickness of 4 mm) were prepared. The cast sheets were made of a magnesium alloy having a composition corresponding to AZ91 alloy (Mg-9.0% Al-1.0% Zn (based on mass)) and were formed by a twin-roll continuous casting process. The cast sheets were subjected to solution treatment at 400° C. for 24 hours. The solid solution sheet subjected to the solution treatment was rolled more than once to a thickness of 0.6 mm under the following rolling conditions.

(Rolling Conditions)

Degree of processing (rolling reduction): 5%/pass to 40%/pass

Heating temperature of sheet: 250° C. to 280° C.

Roll temperature: 100° C. to 250° C.

For the sample No. 1, in each pass of the rolling process, the heating time of a material to be rolled and the rolling speed (roll peripheral speed) were adjusted such that the total time of holding the material at a temperature in the range of 150° C. to 300° C. was 3 hours.

The rolled sheet was subjected to warm straightening at 220° C. to prepare a straightened sheet. The warm straightening was performed using distortion means described in Patent Literature 2. The time of holding the material at a temperature in the range of 150° C. to 300° C. in the straightening process was very short, for example, a few minutes.

The straightened sheet was polished by wet belt polishing with a #600 abrasive belt to prepare a polished sheet (hereinafter also referred to as a sheet).

The polished sheet was subjected to degreasing, acid etching, desmutting, surface conditioning, chemical conversion treatment, and drying in this order to form an anticorrosive layer. The following are specific conditions. The resulting magnesium alloy structural member is hereinafter referred to as a sample No. 1.

Degreasing: 10% KOH and 0.2% nonionic surfactant solution under agitation, 60° C., 10 minutes Acid etching: 5% phosphate solution under agitation, 40° C., 1 minute Desmutting: 10% KOH solution under agitation, 60° C., 10 minutes Surface conditioning: aqueous carbonate solution adjusted to pH 8, under agitation, 60° C., 5 minutes Chemical conversion treatment: trade name Grander MC-1000 (calcium and manganese phosphate chemical coating agent) manufactured by Million Chemicals Co., Ltd., a treatment liquid temperature of 35° C., a dipping time of 60 seconds Drying: 120° C., 20 minutes

[Sample No. 10]

A cast material (having a thickness of 4.2 mm) prepared in the same manner as in the sample No. 1 was rolled under the following conditions and was subjected to heat treatment at 320° C. for 30 minutes instead of (warm) straightening. The heat-treated sheet was polished in the same manner as in the sample No. 1, and an anticorrosive layer was then formed. The resulting magnesium alloy structural member is hereinafter referred to as a sample No. 10.

(Rolling Conditions)

[Rough rolling] From 4.2 mm to 1 mm in thickness

Degree of processing (rolling reduction): 20%/pass to 35%/pass

Heating temperature of sheet: 300° C. to 380° C.

Roll temperature: 180° C.

[Finish rolling] From 1 mm to 0.6 mm in thickness

Degree of processing (rolling reduction): average 7%/pass

Heating temperature of sheet: 220° C.

Roll temperature: 170° C.

The total time of holding at a temperature in the range of 150° C. to 300° C. after solution treatment in the sample No. 10 was 15 hours.

[Sample No. 110]

A wrought material (a sheet having a thickness of 0.6 mm) made of commercially available AZ31 alloy was polished in the same manner as in the sample No. 1, and an anticorrosive layer was then formed. The resulting magnesium alloy structural member is hereinafter referred to as a sample No. 110.

[Sample No. 120]

A cast material (a sheet having a thickness of 0.6 mm) made of commercially available AZ91 alloy was polished in the same manner as in the sample No. 1, and an anticorrosive layer was then formed. The resulting magnesium alloy structural member is hereinafter referred to as a sample No. 120.

The metallographic structures of the substrate of the sample No. 1 (straightened sheet) and the substrate of the sample No. 10 (heat-treated sheet) thus manufactured and the AZ31 alloy wrought material of the sample No. 110 thus prepared were observed to examine a precipitate in the following manner.

Figure 6:
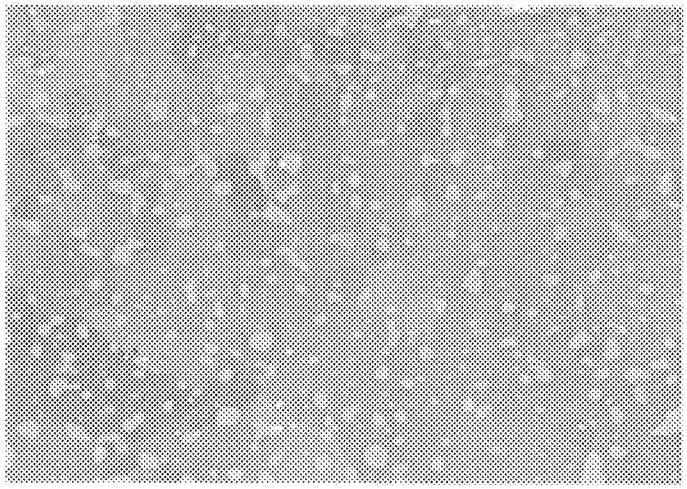
FIG. 6 shows photomicrographs (×5000) of a magnesium alloy material.
Figure 6:
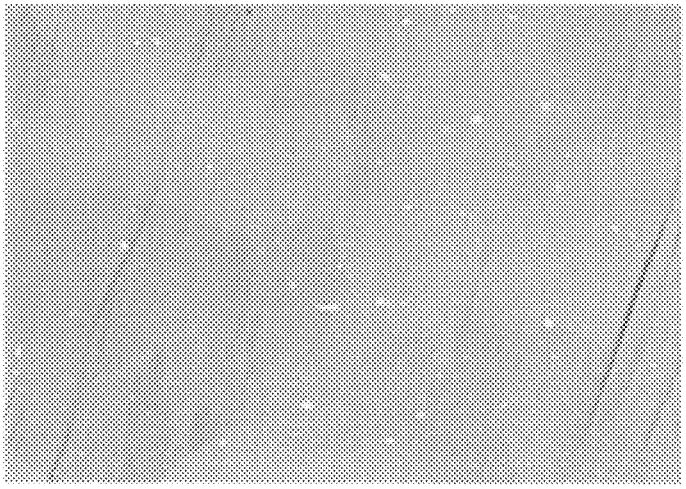

The substrates and the wrought material were cut in the thickness direction, and the cross sections were observed with a scanning electron microscope (SEM) (×5000). FIG. 6(I) shows an image of the sample No. 1, and FIG. 6(II) shows an image of the sample No. 110. In FIG. 6, light gray (white) grains are precipitates.

The ratio of the total area of the precipitate particles to the cross section was determined in the following manner. Three fields (22.7 μm×17 μm) were determined for each image of five cross sections of each of the substrates and the wrought material. The total area of all the precipitate particles in one observation field was calculated from the area of each of the precipitate particles. The ratio (total particle area)/(observation field area) of the total area of all the particles in one observation field to the area of the observation field (385.9 $\mu m^2$) was determined. The ratio is hereinafter referred to as an observation field area percentage. Table IV shows the average of 15 observation field area percentages for each of the substrates and the wrought material.

The ratio of the average particle size of the precipitate particles to the cross section was determined in the following manner. For each observation field, the diameter of a circle having an area equivalent to the area of each particle in one observation field was determined to prepare a particle size histogram. When the particle areas integrated from a smallest particle area reaches 50% of the total particle area of an observation field, the particle size at that point, that is, the 50% particle size (area) is the average particle size of the observation field. Table IV shows the average particle size of 15 observation fields for each of the substrates and the wrought material.

The area and diameter of the particles can be easily determined with a commercial image processor. An analysis by energy dispersive X-ray spectroscopy (EDS) showed that the precipitates were made of an intermetallic compound containing Al or Mg, such as $Mg_{17}Al_{12}$. The presence of particles made of the intermetallic compound can also be detected by analyzing the composition and structure of the particles by X-ray diffraction.

Figure 7:
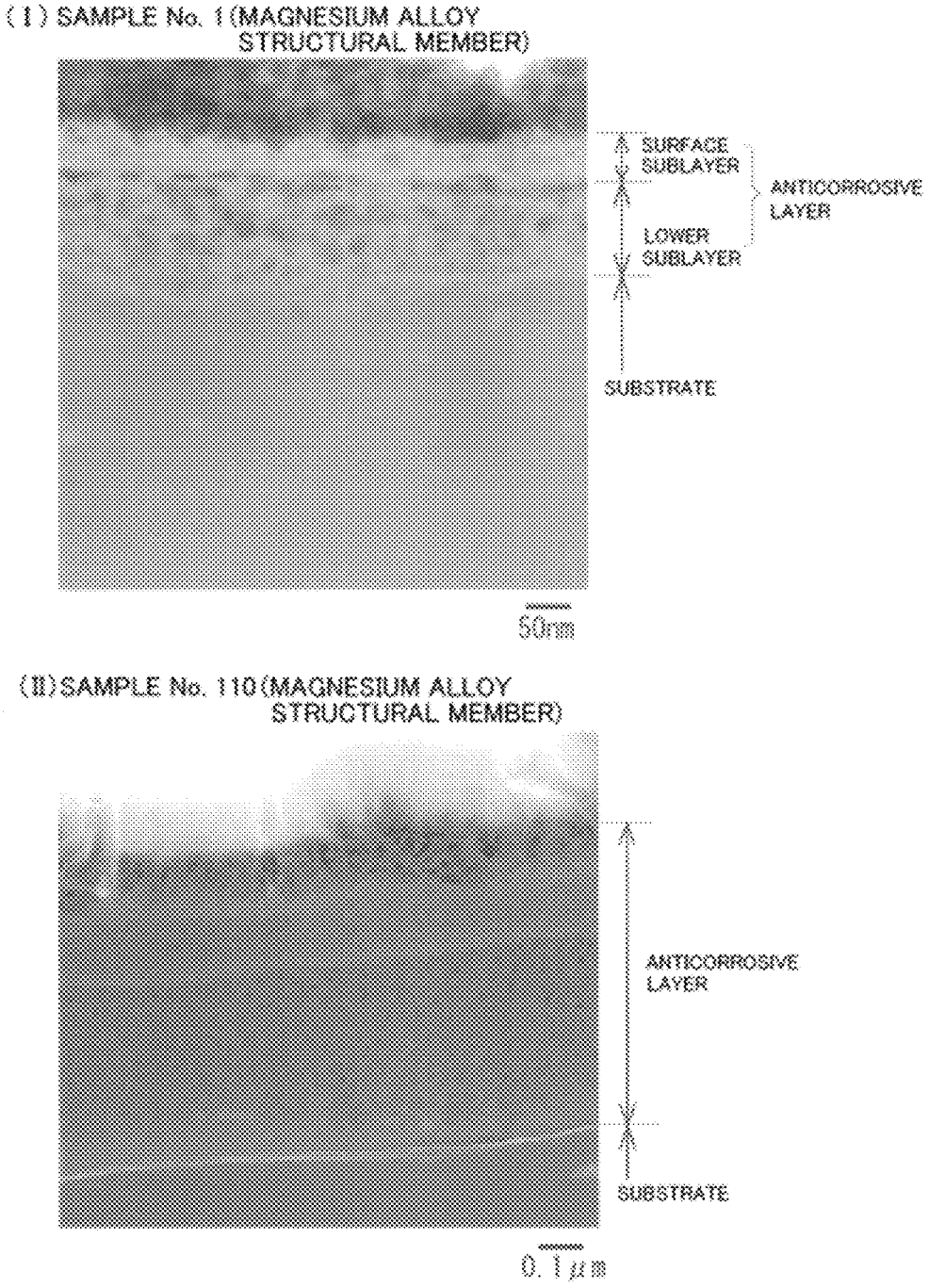
FIG. 7 shows photomicrographs of a cross section of a magnesium alloy structural member having an anticorrosive layer.

An anticorrosive layer formed by chemical conversion treatment on a cross section of a sample (magnesium alloy structural member) in the thickness direction was observed with a transmission electron microscope (TEM). FIG. 7(I) shows an image of the sample No. 1 (×250,000), and FIG. 7(II) shows an image of the sample No. 110 (×100,000). A black region in the upper portion of FIG. 7(I) and a white region in the upper portion of FIG. 7(II) were protective layers formed in the preparation of the cross sections.

Table IV shows the median and dispersion of an image of the anticorrosive layer with a 256 gray scale (an intermediate value method) (n=1). The median and dispersion of the gray scale can be easily determined with a commercial image processor. A small dispersion indicates a dense state with a small number of pores, and a large dispersion indicates a porous state with a large number of pores.

The thickness (the average of the thicknesses at five points in the image) of the anticorrosive layer in each of the samples was determined from their images. Table IV shows the measurements.

The corrosion resistance of the samples was determined in a corrosion resistance test. The corrosion resistance test conformed to JIS Z 2371 (2000) (salt spray time: 96 hours, 35° C.), and a variation in weight (corrosion loss) caused by salt spray was measured. The variation in weight of more than 0.6 mg/cm$^2$ was rated poor (a cross in Table IV), 0.6 mg/cm$^2$ or less was rated good (circle), and less than 0.4 mg/cm$^2$ was rated excellent (double circle). Table IV shows the results.

TABLE IV

| | | Intermetallic compound (precipitate) | | Anticorrosive layer | | | | | | |
|---|---|---|---|---|---|---|---|---|---|---|
| | | Average | Area | Median | | Dispersion | | Thickness (nm) | | |
| Sample No. | Composition | particle size (μm) | percentage (% by area) | Lower sublayer | Surface sublayer | Lower sublayer | Surface sublayer | Lower sublayer | Surface sublayer | Corrosion resistance |
| 1 | AZ91 | 0.1 | 6 | 120 | 150 | 14 | 8 | 150 | 50 | ◎ |
| 10 | AZ91 | 0.2 | 15 | 120 | | 10 | | 100 | | ○ |
| 110 | AZ31 Wrought material | 0.07 | 0.4 | 80 | | 18 | | 600 | | X |
| 120 | AZ91 cast material | — | — | — | | — | | — | | ○ |

Table IV shows that when the total time of holding a material at a temperature in the range of 150° C. to 300° C. after solution treatment is in a particular range and when the material is not heated to more than 300° C., the resulting magnesium alloy sheet (the substrate of the sample No. 1) contains fine particles of an intermetallic compound dispersed therein, as shown in FIG. 6(I). More specifically, in this substrate, the average size of the intermetallic compound particles is 0.05 μM or more and 1 μM or less, and the total area of the intermetallic compound particles accounts for 1% or more and 20% or less.

As shown in FIG. 7(I), the anticorrosive layer on the substrate of the sample No. 1 has a two-layer structure that includes a relatively thick lower sublayer adjacent to the substrate in the thickness direction and a relatively thin surface sublayer on the front side. In particular, the lower sublayer is porous with a lower gray scale (median) and a larger dispersion than the surface sublayer, and the surface sublayer is dense with a higher gray scale and a smaller dispersion than the lower sublayer. An analysis of the composition of the anticorrosive layer with an energy dispersive X-ray spectrometer (EDX) showed that the main component was a phosphate compound of manganese and calcium, the lower sublayer adjacent to the substrate had a higher Al content than the surface sublayer, and the surface sublayer had a higher manganese and calcium content than the lower sublayer.

Table IV shows that the sample No. 1 having the structure described above had excellent corrosion resistance.

In contrast, the sample No. 110 formed of the AZ31 alloy wrought material contained a very small number of precipitates as shown in FIG. 6(II). Furthermore, as shown in FIG. 7(II), the anticorrosive layer is porous and very thick. Table IV shows that the sample No. 110 had poor corrosion resistance. This is probably because the anticorrosive layer did not include a dense surface sublayer such as that in the sample No. 1 and was porous and thick, which accelerated the permeation of a corrosive liquid through a crack, and also because the substrate contained small amounts of Al (dissolved Al) and intermetallic compound.

In the sample No. 120 formed of the AZ91 alloy cast material, the anticorrosive layer was more porous than the surface sublayer of the sample No. 1 and thicker than the sample No. 1. The sample No. 120 was inferior in corrosion resistance to the sample No. 1. This is probably because the thick film caused a crack and thereby accelerated the permeation of a corrosive liquid.

Table IV also shows that the area percentage of the precipitate in the sample No. 10 subjected to heat treatment of more than 300° C. is larger than that in the sample No. 1. The anticorrosive layer of the sample No. 10 is more porous than the surface sublayer of the sample No. 1 and is inferior in corrosion resistance to the sample No. 1. This is probably because the substantial absence of the dense surface sublayer allowed the corrosive liquid to permeate more easily than the sample No. 1.

These results show that a magnesium alloy material made of a magnesium alloy having an Al content of more than 7.5% by mass and prepared in the manufacturing processes after solution treatment such that the total time of holding at a temperature in the range of 150° C. to 300° C. is in the range of 0.5 to 12 hours and that the substrate is not heated to a temperature of more than 300° C. contains uniformly dispersed fine precipitate particles, for example, made of an intermetallic compound. Furthermore, the magnesium alloy material had excellent impact resistance, as described in the test example 1. Chemical conversion treatment of a substrate of the magnesium alloy material results in the formation of a magnesium alloy structural member having excellent corrosion resistance.

The Charpy impact value, and the elongation, tensile strength, and 0.2% proof stress in the high-speed tensile test and the low-speed tensile test of the magnesium alloy structural member having an anticorrosive layer prepared in the test example 2 were measured in the same manner as the test example 1. The Charpy impact value was 30 J/cm$^2$ or more, the elongation (high speed) was 10% or more, the tensile strength (high speed) was 300 MPa or more, and the elongation (at high speed) $EL_{hg}$ was at least 1.3 times higher than the elongation (at low speed) $EL_{low}$.

The structure of the AZ91 wrought material of the sample No. 1 prepared in the test example 1 was observed in the same manner. Like the sheet of the sample No. 1 prepared in the test example 2, the AZ91 wrought material of the sample No. 1 contained fine precipitate particles made of an intermetallic compound dispersed therein. The particles had an average particle size of 0.1 μM (100 nm), and the total area of the precipitate particles accounted for 6%.

These embodiments may be modified without departing from the gist of the present invention and are not limited to the constituents described above. For example, the composition (in particular, the Al content) of the magnesium alloy, the thickness and shape of the magnesium alloy material, and the constituent materials of the anticorrosive layer may be modified.

INDUSTRIAL APPLICABILITY

A magnesium alloy material according to the present invention can be suitably used in parts that require excellent impact resistance, typically, parts of automobiles, such as bumpers, parts of various electronic devices, for example, housings for mobile or small electronic devices, and constituent materials of parts in various applications that require high strength.

REFERENCE SIGNS LIST

10 Test specimen
11 Plastic strain gage
12 Elastic strain gage

The invention claimed is:

1. A magnesium alloy structural member comprising:

a substrate including a magnesium alloy material comprising a magnesium alloy that contains 8.3% to 9.5% by mass of Al, wherein the magnesium alloy material has a Charpy impact value of 30 J/cm$^2$ or more; and an anticorrosive layer having a two-layer structure that includes a lower sublayer adjacent to the magnesium alloy material and a surface sublayer formed on the lower sublayer, wherein the surface sublayer is denser than the lower sublayer, and the lower sublayer is a porous layer.

2. The magnesium alloy structural member according to claim 1, wherein the magnesium alloy material has an elongation of 10% or more at a tension speed of 10 m/s in a high-speed tensile test.

3. The magnesium alloy structural member according to claim 1, wherein the magnesium alloy material has a tensile strength of 300 MPa or more at a tension speed of 10 m/s in a high-speed tensile test.

4. The magnesium alloy structural member according to claim 1, wherein the magnesium alloy material has an elongation $EL_{hg}$ at a tension speed of 10m/s in a high-speed tensile test 1.3 times or more higher than an elongation $EL_{low}$ at a tension speed of 2 mm/s in a low-speed tensile test.

5. The magnesium alloy structural member according to claim 1, wherein the magnesium alloy contains precipitate particles dispersed therein, the precipitate particles have an average particle size of 0.05 μm or more and 1 μm or less, and the total area of the precipitate particles in a cross section of the magnesium alloy material accounts for 1% or more and 20% or less of the cross section.

6. The magnesium alloy structural member according to claim 5, wherein the precipitate particles include particles made of an intermetallic compound containing at least one of Al and Mg.

7. The magnesium alloy structural member according to claim 1, wherein the anticorrosive layer having the two-layer structure has a total thickness of 50 nm or more and 300 nm or less.

8. The magnesium alloy structural member according to claim 1, wherein the lower sublayer constitutes approximately 60% to 75% of a total thickness of the anticorrosive layer.

9. The magnesium alloy structural member according to claim 7, wherein the lower sublayer constitutes approximately 60% to 75% of a total thickness of the anticorrosive layer.

10. The magnesium alloy structural member according to claim 1, wherein the lower sublayer is thicker than the surface sublayer.

11. The magnesium alloy structural member according to claim 7, wherein the lower sublayer is thicker than the surface sublayer.

12. The magnesium alloy structural member according to claim 1, wherein the anticorrosive layer has a composition in which a main component is a phosphate compound of manganese and calcium.

13. The magnesium alloy structural member according to claim 1, wherein the lower sublayer adjacent to the substrate has a higher Al content than the surface sublayer.

14. The magnesium alloy structural member according to claim 1, wherein the surface sublayer has a higher manganese and calcium content than the lower sublayer.

15. The magnesium alloy structural member according to claim 12, wherein the lower sublayer adjacent to the substrate has a higher Al content than the surface sublayer, and wherein the surface sublayer has a higher manganese and calcium content than the lower sublayer.

* * * * *